US010591946B2

(12) United States Patent
Luo et al.

(10) Patent No.: US 10,591,946 B2
(45) Date of Patent: Mar. 17, 2020

(54) ELECTRONIC DEVICE, POWER CIRCUIT APPLIED TO THE ELECTRONIC DEVICE, AND ASSOCIATED METHOD

(71) Applicant: Realtek Semiconductor Corp., HsinChu (TW)

(72) Inventors: Chun-Yu Luo, Taoyuan (TW); Shih-Chieh Chen, Yilan County (TW); Liang-Hui Li, Hsinchu County (TW); Yi-Lin Li, Hsinchu (TW)

(73) Assignee: Realtek Semiconductor Corp., HsinChu (TW)

( * ) Notice: Subject to any disclaimer, the term of this patent is extended or adjusted under 35 U.S.C. 154(b) by 0 days.

(21) Appl. No.: 16/028,432

(22) Filed: Jul. 6, 2018

(65) Prior Publication Data

US 2019/0018439 A1 Jan. 17, 2019

Related U.S. Application Data

(60) Provisional application No. 62/531,886, filed on Jul. 13, 2017.

(30) Foreign Application Priority Data

Mar. 15, 2018 (TW) ..... 107108895 A

(51) Int. Cl.
*G05F 3/02* (2006.01)
*G05F 1/625* (2006.01)

(52) U.S. Cl.
CPC ..... *G05F 3/02* (2013.01); *G05F 1/625* (2013.01)

(58) Field of Classification Search
CPC ..... G05F 3/02
USPC ..... 327/540
See application file for complete search history.

(56) References Cited

U.S. PATENT DOCUMENTS 6,885,233 B2 * 4/2005 Huard ..... G05F 1/46 327/513
7,129,745 B2 * 10/2006 Lewis ..... G06F 17/5054 326/38
9,134,782 B2 * 9/2015 Reddy ..... G06F 1/3203
2002/0029352 A1 * 3/2002 Borkar ..... G06F 1/26 713/320
2004/0128631 A1 * 7/2004 Ditzel ..... G06F 1/3203 716/133
2010/0019834 A1 * 1/2010 Zerbe ..... G06F 1/26 327/538

(Continued)

FOREIGN PATENT DOCUMENTS

CN 101917113 A 12/2010

*Primary Examiner* — Ryan Jager
(74) *Attorney, Agent, or Firm* — Winston Hsu

(57) ABSTRACT

A power circuit applied to an electronic device, includes: a control circuit and a power providing circuit, wherein the control circuit is coupled to at least one circuit installed within the electronic device, and is arranged to generate a providing information according to at least one performance indicator of the circuit, wherein the providing information includes an optimal voltage signal setting, and the optimal voltage signal setting is generated according to a performance coefficient corresponding to each performance indicator; the power providing circuit is coupled to the control circuit and the at least one circuit, and is arranged to dynamically provide a voltage signal to the circuit according to the providing information.

10 Claims, 2 Drawing Sheets

(56) References Cited

U.S. PATENT DOCUMENTS

| | | | | |
|---|---|---|---|---|
| 2011/0273101 | A1* | 11/2011 | Liu | G09G 3/3406 315/192 |
| 2012/0005515 | A1* | 1/2012 | Reddi | G06F 1/28 713/340 |
| 2014/0055077 | A1* | 2/2014 | Barrass | B60L 11/1803 318/700 |
| 2015/0207333 | A1* | 7/2015 | Baarman | H02J 5/005 307/104 |
| 2016/0291625 | A1* | 10/2016 | Tripathi | G05F 3/02 |
| 2017/0344086 | A1* | 11/2017 | Hsiao | G06F 1/266 |
| 2018/0267567 | A1* | 9/2018 | Lo | G01R 17/02 |

* cited by examiner

ELECTRONIC DEVICE, POWER CIRCUIT APPLIED TO THE ELECTRONIC DEVICE, AND ASSOCIATED METHOD

CROSS REFERENCE TO RELATED APPLICATIONS

This application claims the benefit of U.S. Provisional Application No. 62/531,886, which was filed on Jul. 13, 2017 and is incorporated herein by reference.

BACKGROUND OF THE INVENTION

1. Field of the Invention

The present invention relates to a power circuit, and more particularly, to a power circuit which dynamically adjusts a provided voltage signal according to a status of the power circuit.

2. Description of the Prior Art

A power circuit applied to an electronic device for providing power must simultaneously provide power to a plurality of circuits with a variety of functions. A voltage signal provided by a traditional power circuit does not have high flexibility. Because the most valuable performance for each circuit is different, e.g. some circuits value low noise while some value maximum loading current, the voltage signals required by every circuit are distinct. When all circuits receive a same voltage signal at the same time, the performances thereof cannot be optimized. For example, when a voltage signal is provided for optimizing a first circuit among a plurality of circuits, the performance of a second circuit or a third circuit is also influenced. Hence, a power circuit capable of dynamically providing voltage signals according to a variety of statuses of the circuits is required.

SUMMARY OF THE INVENTION

One of the objectives of the present invention is to provide an electronic device, a power circuit applied to the electronic device, and an associated method to solve the aforementioned problem.

According to an embodiment of the present invention, a power circuit applied to an electronic device is disclosed. The power circuit comprises a control circuit and a power providing circuit. The control circuit is coupled to at least one circuit of the electronic device, and is configured to generate a providing information according to at least one performance indicator of the at least one circuit, wherein the providing information comprises an optimal voltage signal setting, and the optimal voltage signal setting is generated according to a performance coefficient corresponding to each performance indicator. The power providing circuit is coupled to the control circuit and the at least one circuit, and is configured to generate a voltage signal to the at least one circuit according to the providing information.

According to an embodiment of the present invention, a method applied to an electronic device is disclosed, comprising: generating a providing information according to at least one performance indicator of the at least one circuit, wherein the providing information comprises an optimal voltage setting, and the optimal voltage setting is generated according to an performance coefficient corresponding to each performance indicator; and dynamically generating a voltage signal to the at least one circuit according to the providing information.

According to an embodiment of the present invention, an electronic device is disclosed. The electronic device comprises at least one circuit, a control circuit and a power providing circuit. The control circuit is coupled to the at least one circuit of the electronic device, and is configured to generate a providing information according to at least one performance indicator of the at least one circuit, wherein the providing information comprises an optimal voltage signal setting, and the optimal voltage signal setting is generated according to a performance coefficient corresponding to each performance indicator. The power providing circuit is coupled to the control circuit and the at least one circuit, and is configured to generate a voltage signal to the at least one circuit according to the providing information.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should not be interpreted as a close-ended term such as "consist of". Also, the term "couple" is intended to mean either an indirect or direct electrical connection. Accordingly, if one device is coupled to another device, that connection may be through a direct electrical connection, or through an indirect electrical connection via other devices and connections.

Figure 1:
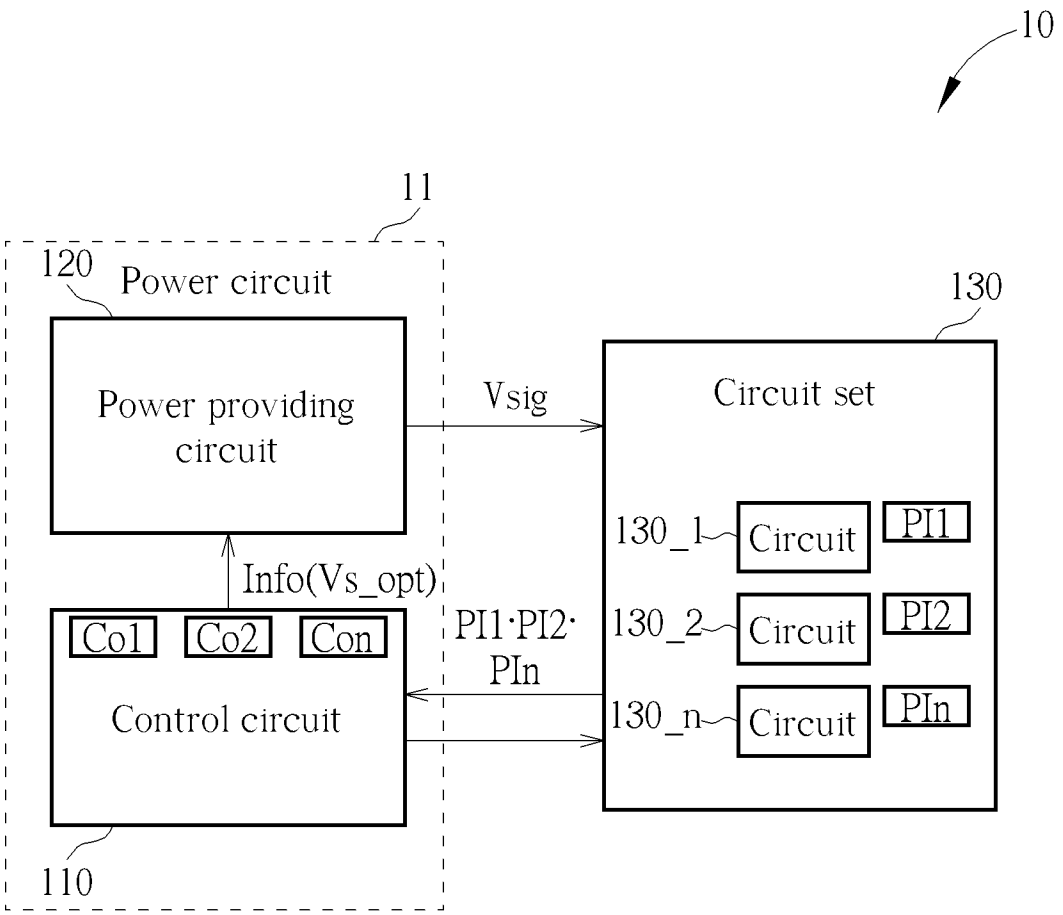
FIG. 1 is a diagram illustrating an electronic device according to an embodiment of the present invention.

FIG. 1 is a diagram illustrating an electronic device 10 according to an embodiment of the present invention. As shown in FIG. 1, the electronic device 10 comprises a power circuit 11 and a circuit set 130, wherein the power circuit 11 comprises a control circuit 110 and a power providing circuit 120, and the circuit set 130 comprises circuits 130_1, 130_2, . . . , **130_*n*, where n is an integer greater than 2. It should be noted that the quantity and variety of the circuits comprised in the circuit set 130 is not limited by the present invention. For example, the circuit 130_1 may be a radio frequency circuit, and the circuit 130_2 may be an analog circuit such as an amplifier. The most valuable performance indicators for the circuits 130_1-130_*n* are the performance indicator PI1, the performance indicator PI2, and the performance indicator PIn, respectively, wherein PI1, PI2 and PIn are different from each other. For example, the performance indicators PI1**-PIn can be power consumption, noise, or maximum loading current; however, this is not a limitation of the present invention.

Referring to FIG. 1, when the control circuit 110 is coupled to the circuit set 130, it can actively detect or passively receive performance indicators of the operating circuit (e.g. the performance indicators PI1-PIn of the circuit 130_1-130_*n*) and generate providing information Info to the power providing circuit 120 to make the power providing circuit 120 dynamically provide a voltage signal Vsig according to the providing information Info, wherein the providing information Info comprises information of an optimal voltage setting Vs_opt which may be a setting of a register, a control signal, or a simple switch control. The transmission and the comprised information of the optimal voltage signal setting may be varied according to different embodiments. This is not a limitation of the present invention. For example, when the voltage signal Vsig is generated by using the optimal voltage signal setting Vs_opt, the performance indicator PI1 (e.g. the power consumption) valued by the circuit 130_1 is optimized. Likewise, when a different optimal voltage signal setting Vs_opt is adapted to provide the voltage signal Vsig, the performance indicator PI2 (e.g. the noise) valued by the circuit 130_2 can be effectively optimized. It should be noted that, in this embodiment, the optimal voltage signal setting may comprise the settings of the duty cycle, the frequency, the phase, the amplitude, the magnitude or the voltage providing mode of the voltage signal Vsig, wherein the voltage providing mode may comprise Pulse Width Modulation (PWM) or Pulse Frequency Modulation (PFM), etc. This is not a limitation of the present invention, however; the purpose of the voltage signal Vsig is to optimize the most valuable performance indicators PI1-PIN of the circuits 130_1-130_*n*.

When the circuits 130_1-130_*n* operate simultaneously, the control circuit 130 determines the optimal voltage signal setting Vs_opt according to the required performance indicators (PI1-PIn) and the given performance coefficients (Co1-Con). More specifically, when only the circuit 130_1 in the circuit set 130 is operating, the control circuit 110 receives or detects the performance indicator PI1, and also acquires the corresponding optimal voltage signal setting Vs_opt. In this case, as only one performance indicator is concerned, the control circuit 110 sets the performance coefficient corresponding to the performance indicator PI1 as 1, and transmits the providing information Info comprising the optimal voltage signal setting Vs_opt to the power providing circuit 120. The power providing circuit 120 sets the voltage signal Vsig with the optimal voltage signal setting Vs_opt according to the indication of the providing information Info, and transmits the voltage signal Vsig to the circuit 130_1. Hence, the circuit 130_1 can operate under the condition that the performance indicator PI1 is optimized. When the circuits 130_1 and 130_2 in the circuit set 130 are also operating, the control circuit 110 receives or detects the performance indicators PI1 and PI2, and the control circuit 110 may set the performance coefficients Co1 and Co2 according to the designer's consideration or the applications. For example, the performance coefficient Cp1 is set as 0.7 while the performance coefficient Co2 is set as 0.3. The optimal voltage signal setting Vs_opt is acquired according to the performance indicators PI1 and PI2 and performance coefficients Co1 and Co2.

The control circuit 110 then transmits the providing information Info comprising the optimal voltage signal setting Vs_opt to the power providing circuit 120. The voltage signal Vsig provided to the circuits 130_1 and 130_2 by the power providing circuit 120 is the result determined with the performance coefficient Co1 set as 0.7 and the performance coefficient Co2 set as 0.3. This is not a limitation of the present invention; the proportion of the voltage signal settings used for setting the voltage signal Vsig is not limited to be the same as the ratio of the performance coefficients. This embodiment is only for illustrative purposes. The higher the nth performance coefficient, the higher the ratio of the nth performance indicator referred to by the voltage signal Vsig. In addition, it should be noted that when the control circuit 110 acquires the plurality of performance indicators (e.g. the performance indicators PI1 and PI2), the invention is not limited to the control circuit 110 setting the corresponding performance coefficients Co1 and Co2 immediately. The electronic device 10 may further comprise a storage device (not shown in FIG. 1), wherein the storage device stores a look-up table in advance. The look-up table lists different combinations of performance indicators and the corresponding performance coefficients. The optimal voltage signal settings optimizing every performance indicator (e.g. the performance indicators PI1-PIn) can also be stored in the storage device to make the control circuit 110 acquire the voltage signal setting from the storage device after the performance indicators PI1-PIn are received. In addition, in other embodiments, some simplified options may be determined in advance. Therefore, a suitable voltage signal setting can be adapted among limited options under different conditions.

Figure 2:
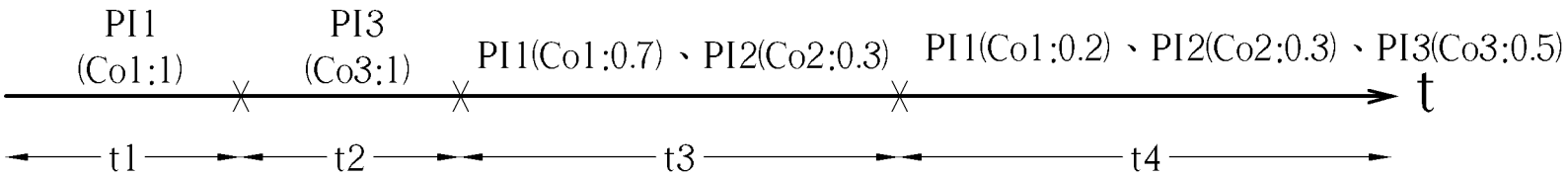
FIG. 2 is a diagram illustrating dynamically providing voltage signals based on a performance indicator according to an embodiment of the present invention.

FIG. 2 is a diagram illustrating dynamically providing voltage signals based on performance indicators according to an embodiment of the present invention. In this embodiment, assume n is 3, i.e. the circuit set 130 comprises the circuits 130_1-130_3. As shown in FIG. 2, in the time period t1, only the circuit 130_1 is operating. In this case, the control circuit 110 acquires the performance indicator PI1, and sets the performance coefficient Co1 as 1 accordingly. Next, in the time period t2, only the circuit 130_3 is operating. In this case, the control circuit 110 acquires the performance indicator PI3, and sets the performance coefficient Co3 as 1 accordingly. In the time period t3, the circuits 130_1 and 130_2 are operating. In this case, the control circuit 110 acquires the performance indicators PI1 and PI2, and sets (or by the look-up table) the performance coefficient Co1 as 0.7 and the performance coefficient Co2 as 0.3. In the time period t4, the circuits 130_1-130_3 are operating. In this case, the control circuit 110 acquires the performance indicators PI1-PI3, and sets (or by the look-up table) the performance coefficient Co1 as 0.2, the performance coefficient Co2 as 0.3, and the performance coefficient Co3 as 0.5. The control circuit further determines the optimal voltage signal setting Vs_opt in the time period t1, t2, t3 and t4. It should be noted that the lengths of the time periods t1-t4 shown in FIG. 2 are only for illustrative purposes. The actual lengths are based on the status of the circuits.

Briefly summarized, the present invention discloses an electronic device and a power circuit applied to the electronic device, wherein the power circuit dynamically adjusts the provided voltage signals according to the operating status of the circuit in the electronic device and the most valuable performance indicators to optimize the performance of the circuits as much as possible.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A power circuit applied to an electronic device, comprising:

a control circuit, coupled to a plurality of circuits of the electronic device, wherein the control circuit is configured to generate a providing information according to a plurality of performance indicators corresponding to the plurality of circuits, respectively, the providing information comprises an optimal voltage signal setting, and the optimal voltage signal setting is generated according to a performance coefficient corresponding to each performance indicator; and a power providing circuit, coupled to the control circuit and the plurality of circuits, wherein the power providing circuit is configured to generate a voltage signal to the plurality of circuits according to the providing information;

wherein the higher the performance coefficient, the higher a ratio of a corresponding performance indicator referred to by the voltage signal.

2. The power circuit of claim 1, wherein the optimal voltage signal setting comprises settings of a duty cycle, a frequency, a phase, an amplitude or a voltage providing mode.

3. The power circuit of claim 1, wherein when the power providing circuit provides the voltage signal according to the optimal voltage signal setting, a proportion of the optimal voltage signal setting in the voltage signal and the performance coefficient are positively correlated.

4. The power circuit of claim 1, wherein the plurality of performance indicators comprises a power consumption, a noise, or a maximum loading current.

5. A method applied to an electronic device, comprising:

generating a providing information according to a plurality of performance indicators corresponding to a plurality of circuits, respectively, wherein the providing information comprises an optimal voltage setting, and the optimal voltage setting is generated according to a performance coefficient corresponding to each performance indicator; and dynamically generating a voltage signal to the plurality of circuits according to the providing information;

wherein the higher the performance coefficient, the higher a ratio of a corresponding performance indicator referred to by the voltage signal.

6. The method of claim 5, wherein the optimal voltage signal setting comprises settings of a duty cycle, a frequency, a phase, an amplitude, or a voltage providing mode.

7. The method of claim 5, wherein when the power providing circuit provides the voltage signal according to the optimal voltage signal setting, a proportion of the optimal voltage signal setting in the voltage signal and the performance coefficient are positively correlated.

8. The method of claim 5, wherein the plurality of performance indicators comprises a power consumption, a noise, or a maximum loading current.

9. An electronic device, comprising:

a plurality of circuits;

a control circuit, coupled to the plurality of circuits, wherein the control circuit is configured to generate a providing information according to a plurality of performance indicators corresponding to the plurality of circuits, respectively, the providing information comprises an optimal voltage signal setting, and the optimal voltage signal setting is generated according to a performance coefficient corresponding to each performance indicator; and a power providing circuit, coupled to the control circuit and the plurality of circuits, wherein the power providing circuit is configured to generate a voltage signal to the plurality of circuits according to the providing information;

wherein the higher the performance coefficient, the higher a ratio of a corresponding performance indicator referred to by the voltage signal.

10. The electronic device of claim 9, wherein the optimal voltage signal setting comprises settings of a duty cycle, a frequency, a phase, an amplitude, or a voltage providing mode.

* * * * *